US006776572B2

(12) United States Patent
Reist

(10) Patent No.: US 6,776,572 B2
(45) Date of Patent: Aug. 17, 2004

(54) METHOD AND DEVICE FOR STACKING FLAT ARTICLES

(75) Inventor: Walter Reist, Hinwil (CH)

(73) Assignee: Ferag AG, Hinwil (CH)

( * ) Notice: Subject to any disclaimer, the term of this patent is extended or adjusted under 35 U.S.C. 154(b) by 73 days.

(21) Appl. No.: 10/196,801

(22) Filed: Jul. 17, 2002

(65) Prior Publication Data

US 2003/0017043 A1 Jan. 23, 2003

(30) Foreign Application Priority Data

Jul. 18, 2001 (CH) ..... 1334/01

(51) Int. Cl.[7] ..... B65G 57/09; B65G 57/00; B65H 29/00; B65H 31/30

(52) U.S. Cl. ..... 414/794.4; 414/789.9; 414/790.3

(58) Field of Search ..... 414/789.9, 790.3, 414/790.4, 794.4; 271/207, 149, 150

(56) References Cited

U.S. PATENT DOCUMENTS 2,679,789 A 6/1954 Graves
3,593,624 A * 7/1971 Dufour ..... 414/788.3
3,724,640 A * 4/1973 Rapparlie ..... 414/790.4
6,010,300 A 1/2000 Seefeldt
6,042,108 A * 3/2000 Morgan et al. ..... 271/201
6,491,492 B1 * 12/2002 Cook ..... 414/789.9

FOREIGN PATENT DOCUMENTS

DE 28 00 383 A1 7/1978
DE 195 38 065 A1 4/1997

* cited by examiner

*Primary Examiner*—Gene O. Crawford
(74) *Attorney, Agent, or Firm*—Rankin, Hill, Porter & Clark LLP

(57) ABSTRACT

For stacking flat articles (2), a stacking shaft (10) including a pusher (11) for removing stacks from the shaft is used and for supplying the articles (2) into the stacking shaft (10) a supply support (12) is used. The supply support (12) is oriented towards the opening of the stacking shaft (10) at an inclination from above and the completed stacks (1) are pushed out in a direction opposite the supply direction. With this arrangement, it is possible to resume the supply operation after an interruption necessary for the pushing-out, before the stack (1) is pushed out of the stacking shaft (10) completely, and thereby results in very short cycle times. The stacking method is suitable in particular for stacking folded printed products being supplied in the supply stream parallel to their folded edges.

11 Claims, 4 Drawing Sheets

METHOD AND DEVICE FOR STACKING FLAT ARTICLES

BACKGROUND OF THE INVENTION

1. Field of the Invention

The invention is related to a method and a device for stacking flat articles, in particular for stacking printed products.

2. Description of Related Art

It is known to deposit printed products in stacking shafts or in a similar device for the purpose of producing stacks of printed products. Such devices usually comprise a bottom and guide walls standing vertically on the bottom and they are open on the top for the supply of the printed products. In order to reduce to a minimum the free fall of the printed products during stacking, the position of the bottom or of the supply system is often adapted to the height of the stack already present in the shaft, so that every printed product can be slid substantially horizontally onto the previously deposited printed product or onto the shaft bottom.

For producing cross stacks, in which the printed products are stacked in layers or product groups each respectively rotated by 180° relative to one another, for example, the bottom of the stacking shaft is designed for being rotated, and at least one intermediate bottom, which is removable from the shaft, is provided. Whenever a product group has been deposited, the bottom with the groups already stacked on it is rotated by 180° while the printed products for the subsequent product group are being stacked on the intermediate bottom. When the bottom with the stack is again positioned after rotation, the intermediate bottom, if so required, is lowered into the stacking shaft and is then pulled out of the shaft so that the printed products stacked on the intermediate bottom are deposited on the rotated stack.

When a stack is completed, parts of the vertical guide walls or shaft walls are removed, if so required, and the stack is pushed out of the stacking shaft, usually transverse to the supply direction (or transverse to its projection onto the plane of the stacking shaft bottom, respectively) or in the supply direction. During the whole pushing-out process, the supply has to be interrupted or printed products being supplied have to be pre-stacked on the intermediate bottom.

In many cases, the supply stream is split-up to supply two stacking shafts such that while printed products are being supplied to one shaft, a finished stack is being pushed out of the other stacking shaft.

From the above brief description of the stacking processes as known in the printing field, it is evident that, for their implementation, particularly with high performance capacities or with short cycle times, respectively, rather elaborate devices are necessary. Such elaborate devices require a lot of space.

SUMMARY OF THE INVENTION

It is an object of the invention to create a method for stacking flat articles, which may be implemented with very simple devices and in little space while still allowing high unit processing capacities. It is a further object of the invention to create a device for carrying out the method according to the invention.

In accordance with the invention, the flat articles are supplied to the stacking shaft lying loosely on a supply support or else held clamped between two supply supports, for example in an imbricated formation with the leading edges positioned on the top of the formation. The supply support is, for example, a conveyor belt that brings the articles at an inclination from above toward a supply side of the stacking shaft and advantageously to a position just above the stacking shaft, where the supply support ends. The flat articles are driven by the supply support beyond the end thereof and against a side of the stacking shaft disposed opposite the supply side. The flat articles from the supply support into the stacking shaft at the latest, when their leading edge has reached the opposite side of the stacking shaft.

The completed stacks are pushed out in a pushing-out direction opposite to the supply direction (pushing-out direction opposite to the projection of the supply direction onto the plane of the stacking shaft bottom), i.e. through the supply side of the stacking shaft. For the pushing operation a per se known pusher is used. The pushing movement of the pusher starts at the side opposite the supply side of the stacking shaft and is directed toward the supply side. For returning the pusher back to its starting position, the pusher is moved outside of the stacking shaft, for example, underneath the stacking shaft or besides the stacking shaft.

The article supply is interrupted for a first part of the pushing movement. However, the supply can be resumed as soon as the trailing side of the pushed stack has passed the one point in the stacking shaft, at which a further supplied article comes into contact with the stack to be pushed out, i.e., at which this article would come into conflict with the stack. The article supply does not have to be interrupted for at least as long as the complete pushing operation takes as is necessary with known stacking methods; only a fraction of this time is sufficient. Therefore, stacking with the method according to the invention allows shorter cycle times or a higher capacity, respectively, and/or it allows shorter supply interruptions or less buffered articles, respectively, which means easier handling than is the case with known stacking methods.

The supply interruption necessary for the pushing-out becomes shorter, the more steeply from above supply takes place and the longer a free fall into the stacking shaft, i.e. a fall not guided by the supply support, can be tolerated. Because articles having a greater inherent stiffness can still be stacked well after a longer free fall than more flexible articles, the method in accordance with the invention is particularly adapted for stacking stiffer articles. If the method according to the invention is used for folded printed products, these are advantageously supplied to the stacking shaft in a direction parallel to their folded edge (i.e., for tabloid newspapers with a single fold or for newspapers folded twice: in longitudinal direction), because these products have a significantly greater stiffness parallel to the folded edge than transverse to it. Such supply provides the further advantage, that pushing-out of the stack is directed also parallel to the folded edge, i.e. in the one direction, in which stack stability for folded printed product stacks is greatest.

The method in accordance with the invention is therefore suitable in particular for stacking folded printed products, wherein the products are supplied parallel to their folded edges and the stack is pushed out in the opposite direction, once again parallel to the folded edges. For producing cross stacks, the printed products advantageously are supplied in an imbricated stream with alternating groups of correspondingly oriented products, wherein for supply interruptions the imbricated stream comprises gaps or the printed products are temporarily stopped or dammed.

The device for carrying out the method according to the invention comprises a stacking shaft and a supply support leading from above at an incline towards the supply side of the stacking shaft and ending above the opening of the stacking shaft (directly at the supply side or between the supply side and the opposite side). Furthermore, there is a pushing means that is movable through the stacking shaft in a pushing direction opposite the supply direction and returnable into its starting position on the side of the stacking shaft opposite the supply side not through the stacking shaft. If so required, the device also comprises means for interrupting the supply stream of flat articles.

BRIEF DESCRIPTION OF THE DRAWINGS

These and further features of the invention will be apparent with reference to the following description and drawings, wherein.

DETAILED DESCRIPTION OF THE PREFERRED EMBODIMENTS

Figure 1:
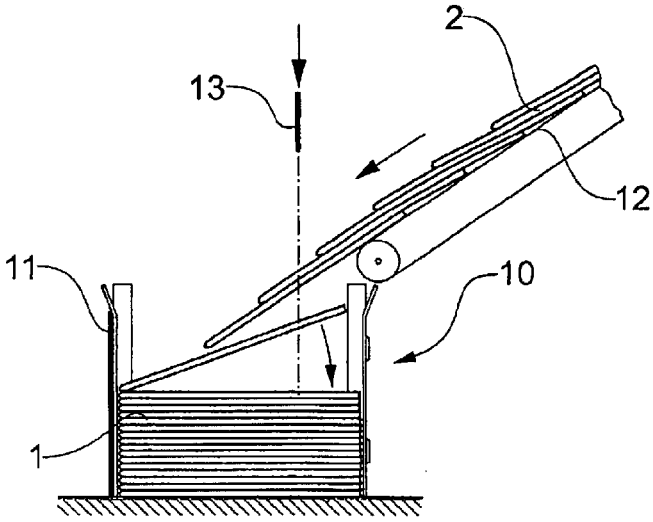
FIGS. 1 to 3 show successive phases of the stacking method according to the invention.
Figure 2:
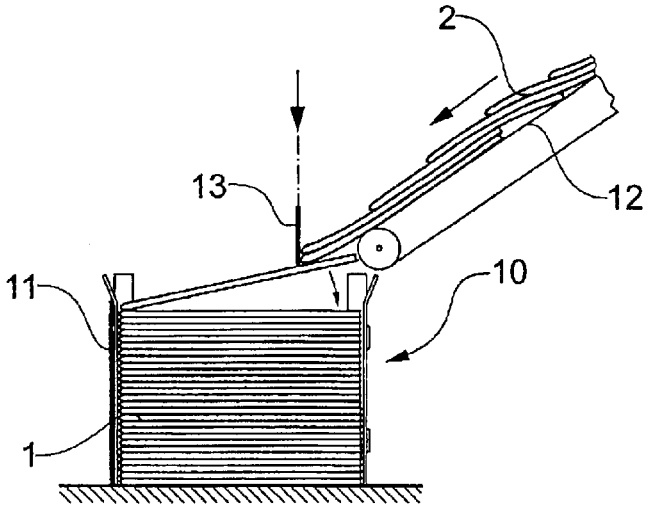
Figure 3:
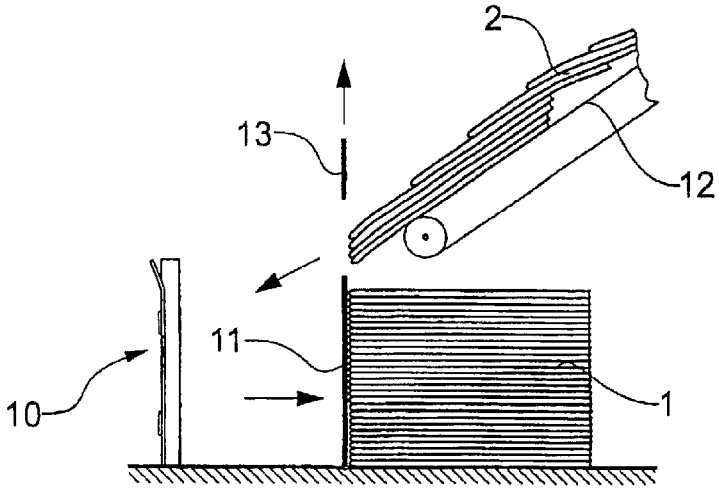

FIGS. 1 to 3 illustrate successive phases of the process of stacking flat articles 2 in stacks 1 using the method according to the invention. The drawings each depict a stacking shaft 10 with a pushing means 11, with a supply support 12 (conveyor belt) leading at an incline from above toward the supply side of the stacking shaft 10, and with means 13 for interrupting the supply stream during a first part of the process of pushing-out a completed stack from the stacking shaft.

FIG. 1 illustrates a growing stack 1. At the moment depicted, the leading edges of supplied articles are making contact with the side of the stacking shaft opposite the supply side, immediately above the stack surface, while the trailing edge at the latest at this point in time is leaving the end of the supply support 12. This means that, for the final positioning of the article, the leading edge is not displaced on the stack anymore. The free-fall of the flat article is guided by the already positioned leading edge. For articles that have been deposited on the stack before the moment in time illustrated in FIG. 1, the free-fall is longer and also affects the leading edge.

FIG. 2 illustrates the depositing of the last article 2 on the stack 1. From this drawing it is evident that the end of the supply support, at least at this point in time, has to have a position, which makes it possible for the trailing edge of this last article also to be separated from the supply support 12 for being able to fall onto stack 1.

While the last article is being positioned on the stack, supply of articles is interrupted, for example, by introducing a damming means 13 into the supply stream of the articles 2. The illustrated damming means 13 is positioned immediately above the stacking shaft 10. It goes without saying, that it may also be effectively provided further upstream.

FIG. 3 depicts the pushing-out of the completed stack 1, which is illustrated after having passed the position that allows restart of the supply of articles 2. Obviously, the remainder of the pushing movement can be carried out, without articles 2 continuing to be fed-in coming into conflict with the stack 1 being pushed out.

Figure 4:
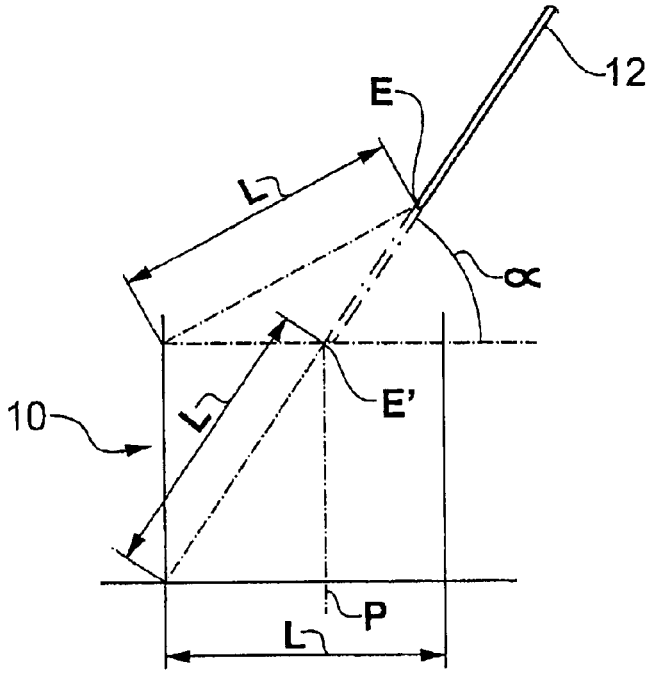
FIGS. 4 and 5 show two schematic diagrams illustrating the association between the duration of the supply interruption, the supply angle and the free fall of the articles to be stacked in the stacking shaft; and, FIGS. 6 and 7 show two exemplary embodiments of the device in according to the invention.
Figure 5:
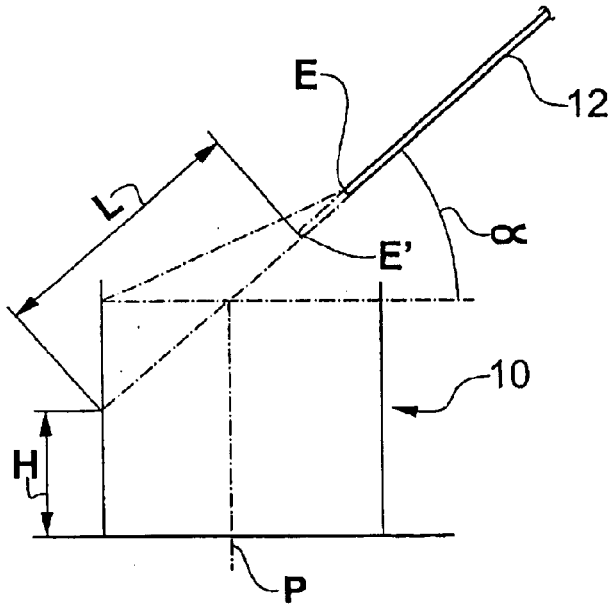

FIGS. 4 and 5 illustrate the association between the orientation and the position of the supply support 12, the stacking process, and the pushing-out process. The same parts are designated with the same reference numbers as in FIGS. 1 to 3.

The supply support 12 in FIG. 4 forms a supply angle $\alpha$ with the bottom of the stacking shaft 10 and is positioned such that the leading edge of a first article to be stacked (not illustrated) makes contact with the side of the stacking shaft situated opposite the supply side just above the stack shaft bottom. Already in the case of this first article therefore, the free-fall does not affect the leading edge, which is an advantage for a controlled stacking operation.

From FIG. 4 it is clearly evident that the position P to be passed by a pushed stack before restart of article supply is displaced toward the side of the stacking shaft 10 opposite the supply side when the angle $\alpha$ is increased. This also leads to shorter supply interruptions being necessary for the pushing operation.

The position of the end E of the supply support 12 is defined by the length L and stiffness of the flat articles such that the trailing edge of the last article of a stack is able to fall off this end. Therefore, the distance between the trailing, upper edge of the stack and the end E of the supply support 12 has to be of at least the same size as the length of the articles in the supply direction; this being applicable at least in the case of stiff articles. In the case of flexible flat articles, the named distance can be smaller. For an optimally guided article supply, the end of the supply support 12 can be designed for moving during stacking from a starting position E' closer to the stacking shaft 10 into the end position E as defined above.

FIG. 5 demonstrates that the position P can be displaced further toward the side of the stacking shaft 10 opposite the supply side. Accordingly, the interruption of the article supply necessary for the pushing operation can be shortened further if the supply direction is not oriented towards the stacking shaft bottom, as is illustrated in FIG. 4, but rather contacts the side of the stacking shaft 10 opposite the supply side at a height H above the stacking shaft bottom. This, however, signifies, that for the first articles supplied to the stacking shaft (up to a stacking height, which is equivalent to H), the leading edges are only definitively positioned following a free-fall.

Because various characteristics of the flat articles to be stacked influence the stacking operation, for every type of article to be stacked the optimum parameters $\alpha$ and H have to be determined.

Figure 6:
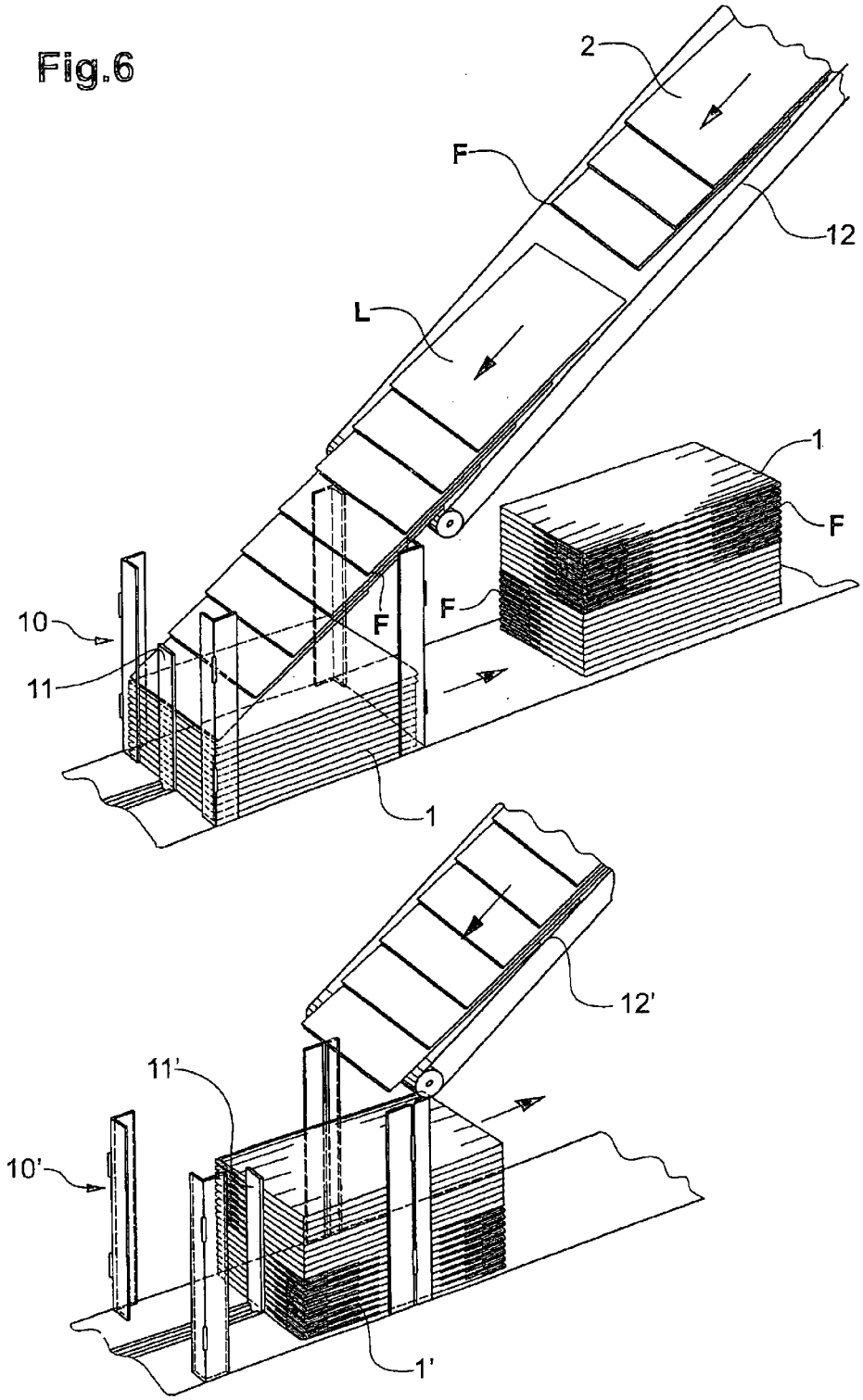

FIG. 6 depicts in a three-dimensional illustration an exemplary embodiment of the device in accordance with the invention. The drawing illustrates two stacking shafts 10 and 10' arranged one above the other, each respectively with a supply support 12 and 12' for supply streams of articles 2 to be stacked. The articles 2 are folded printed products with folded edges F. The printed products are positioned in the illustrated supply streams in alternating groups rotated relative to one another by 180°. The stream also comprises gaps L, which are sufficiently large for constituting supply interruptions for the pushing operation and which, if so required, are utilized for the pushing operation. Between two gaps, several product groups can follow without any gaps such that at every gap a completed stack is pushed out. The stacks 1 and 1' being established are cross stacks.

FIG. 6 illustrates the particularly advantageous application of the method and the device in accordance with the invention for stacking printed products, which are supplied in a supply stream parallel to their folded edges F and already oriented for being stacked cross-wise. It demonstrates how simple and space-saving the device according to the invention is. One skilled in the art knows applicable methods for establishing a supply stream comprising the printed products in groups rotated by 180° relative to one another and further comprising gaps. A preferred method of this kind is the subject of a parallel application to the present patent application.

Figure 7:
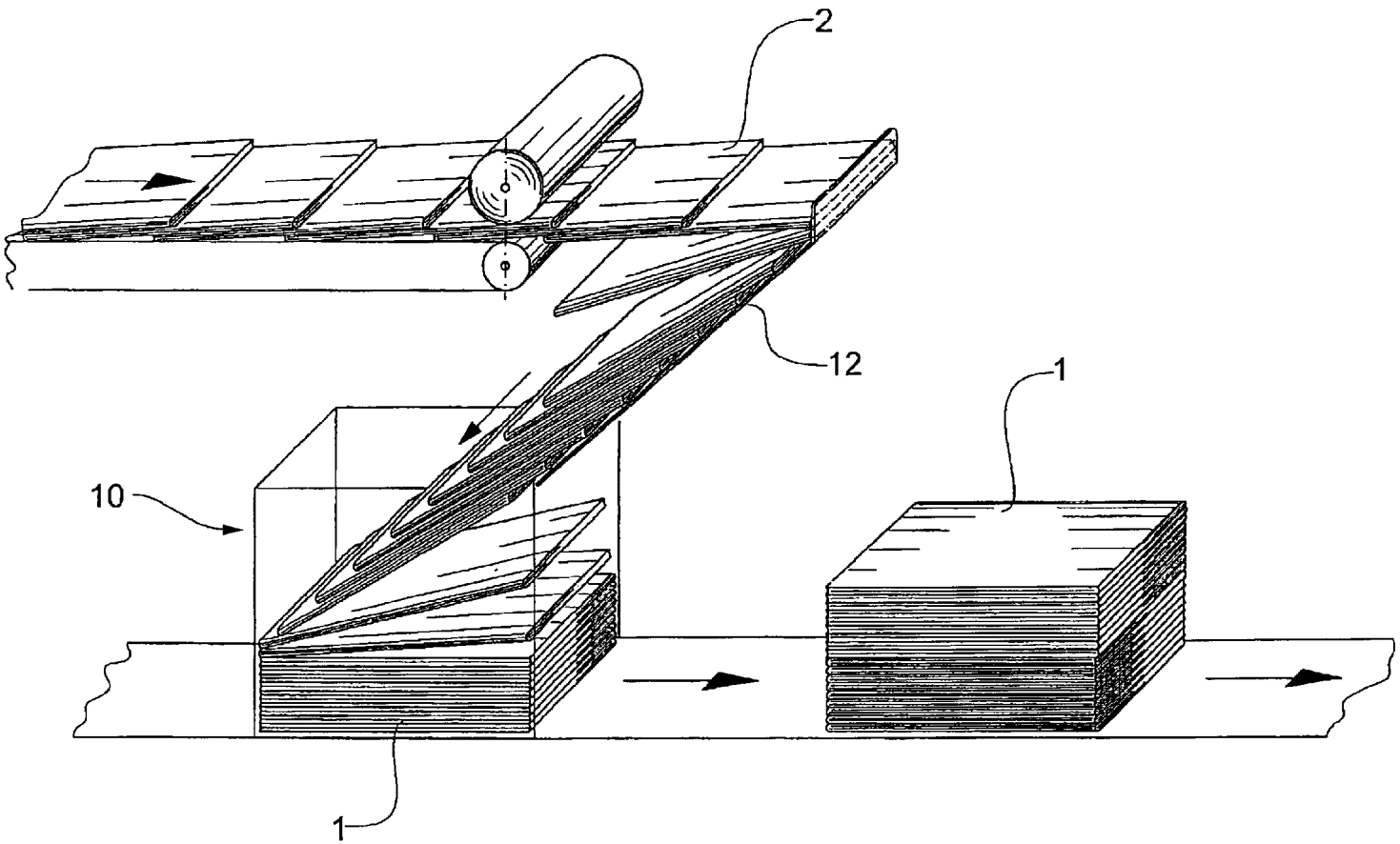

FIG. 7 schematically illustrates a further exemplary embodiment of the device in accordance with the invention. The supply stream of the flat articles 2 to be stacked is first directed parallel to the pushing-out direction. Then, in a zone above the stacking shaft 10, the articles 2 fall onto the supply support 12, which conveys them onwards in the opposite direction and supplies them to the stacking shaft. Here too, the great simplicity of the device and the space-saving arrangement are striking.

What is claimed is:

1. A method for producing stacks (1) of flat articles (2), comprising the steps of:

supplying the flat articles (2) to a stacking shaft (10) in a supply stream, said supply stream being oriented towards the stacking shaft (10) at an incline from above;

stacking the supplied flat articles in the stacking shaft (10); and, pushing a stack (1) of the articles (2) out of the stacking shaft (10) in a direction opposite to the direction of the supply stream by moving pushing means through the stacking shaft (10), away from a starting position;

interrupting the supplying step such that no flat articles (2) are supplied to the stacking shaft (10) during a first part of the pushing step;

resuming the supplying step such that the flat articles (2) are supplied to the stacking shaft (10) before the pushing step is completed and the stack (1) is pushed completely out of the stacking shaft (10); and moving the pushing means back to the starting position along a path that does not extend through the stacking shaft (10).

2. The method according to claim 1, wherein the supply stream is an imbricated stream.

3. The method according to claim 1, wherein the supply stream comprises gaps (L).

4. The method according to claim 1, wherein the interrupting step comprises damming the articles (2) in the supply stream during the first part of the pushing step.

5. The method according to claim 1, wherein the flat articles (2) are folded printed products.

6. The method according to claim 5, wherein the printed products in the supply stream have folded edges (F) and are conveyed parallel to said folded edges (F) and wherein the stack (1) is pushed out parallel to the folded edges (F).

7. The method according to claim 6, wherein the printed products in the supply stream are arranged in groups, said groups being rotated relative to one another by 180°.

8. A device for producing stacks (1) of flat articles (2), the device comprising:

a stacking shaft (10);

a supply support (12) for supplying the articles to the stacking shaft (10) to form a stack (1) therein, wherein the supply support (12) is oriented towards a supply side of the stacking shaft (10) at an inclination from above;

a pushing means (11) for performing a pushing operation wherein the stack (1) of the articles (2) is pushed out of the stacking shaft (10), wherein the pushing means (11) is movable from a starting position, located on a side of the stacking shaft situated opposite the supply side, through the stacking shaft (10) to the supply side and is returnable outside the stacking shaft (10) back into the starting position; and means for interrupting the supply of the flat articles to the stacking shaft (10) during a first part of the pushing operation and for resuming the supply of the articles (2) to the stacking shaft (10) before the pushing operation is completed and the stack (1) is completely pushed out of the stacking shaft (10).

9. The device according to claims 8, wherein the end (E) of the support (12) is arranged above the stacking shaft (10).

10. The device according to claim 8, wherein the end (E) support (12) is displaceable during stacking.

11. The device according to claim 8, wherein the means for interrupting and resuming comprises means (13) for damming the articles (2) in the supply stream.

* * * * *

UNITED STATES PATENT AND TRADEMARK OFFICE

CERTIFICATE OF CORRECTION

PATENT NO. : 6,776,572 B2
DATED : August 17, 2004
INVENTOR(S) : Reist

It is certified that error appears in the above-identified patent and that said Letters Patent is hereby corrected as shown below:

Column 6,
Line 38, after "(E)" insert -- of the supply --.

Signed and Sealed this

Seventh Day of December, 2004

JON W. DUDAS
*Director of the United States Patent and Trademark Office*